US007367741B2

(12) United States Patent
Vogler

(10) Patent No.: US 7,367,741 B2
(45) Date of Patent: May 6, 2008

(54) CONNECTOR ELEMENT FOR A GLASS POST AND BEAM CONSTRUCTION

(75) Inventor: Thomas Vogler, Bad Salzuflen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 101 days.

(21) Appl. No.: 10/499,139

(22) PCT Filed: Dec. 16, 2002

(86) PCT No.: PCT/EP02/14326

§ 371 (c)(1),
(2), (4) Date: Jun. 17, 2004

(87) PCT Pub. No.: WO03/052227

PCT Pub. Date: Jun. 26, 2003

(65) Prior Publication Data

US 2005/0055941 A1 Mar. 17, 2005

(30) Foreign Application Priority Data

Dec. 17, 2001 (DE) ..... 101 62 054

(51) Int. Cl.
*F16C 11/00* (2006.01)

(52) U.S. Cl. ..... 403/121; 403/70; 403/71

(58) Field of Classification Search ..... 403/70, 403/71, 87, 121; 52/235, 306–308; 4/614; 47/17

See application file for complete search history.

(56) References Cited

U.S. PATENT DOCUMENTS 253,540 A * 2/1882 McLean ..... 52/306
1,033,106 A * 7/1912 Kahn ..... 52/306
2,124,809 A * 7/1938 Wright ..... 52/307
2,281,524 A * 4/1942 Meyers ..... 52/306
3,685,240 A 8/1972 Oscari
4,526,294 A * 7/1985 Hirschmann et al.
4,636,413 A * 1/1987 Wittmann et al. ..... 52/306
5,425,208 A * 6/1995 Eekhout ..... 52/235
5,642,959 A * 7/1997 Greferath ..... 403/293
6,519,903 B1 * 2/2003 Dirisamer et al. ..... 52/235
6,694,687 B2 * 2/2004 Elmer ..... 52/235

(Continued)

FOREIGN PATENT DOCUMENTS

DE 3518153 A1 * 11/1986

(Continued)

OTHER PUBLICATIONS

English translation of Kulla DE3518153 A1.*

(Continued)

*Primary Examiner*—Daniel P. Stodola
*Assistant Examiner*—Victor MacArthur
(74) *Attorney, Agent, or Firm*—Cohen Pontani Lieberman & Pavane LLP

(57) ABSTRACT

A connector element for a post and beam construction having load-bearing glass components consisting of load-bearing glass posts and load-bearing glass beams, the connector element including a first fitting fitted to a first load-bearing glass component; a second fitting fitted to a second load-bearing glass component; and a glass load-transmitting element located between the first fitting and the second fitting.

14 Claims, 5 Drawing Sheets

U.S. PATENT DOCUMENTS

| | | | | |
|---|---|---|---|---|
| 6,761,003 | B2 * | 7/2004 | Lind | 52/235 |
| 2004/0037618 | A1 * | 2/2004 | Hermens et al. | 403/122 |
| 2005/0055913 | A1 * | 3/2005 | Nugue et al. | 52/272 |

FOREIGN PATENT DOCUMENTS

| | | | |
|---|---|---|---|
| DE | 198 18 727 | A1 | 11/1999 |
| EP | 0 931 943 | A2 | 7/1999 |
| EP | 1026356 | A2 * | 8/2000 |

OTHER PUBLICATIONS

"Glasträger, Bericht Nr. 20, ETH Zürich, Institut für Hochbautechnik" [Glass Beams, Report No. 20, Zurich Institute of Technology, Department of Structural Engineering], pp. 31& 32.

* cited by examiner

CONNECTOR ELEMENT FOR A GLASS POST AND BEAM CONSTRUCTION

CROSS-REFERENCE TO RELATED APPLICATIONS

This is a U.S. national stage of application No. PCT/EP02/14326, filed on 16 Dec. 2002. Priority under 35 U.S.C. §119(a) and 35 U.S.C. §365(b) is claimed from German Application No. 101 62 054.3, filed 17 Dec. 2001.

BACKGROUND OF THE INVENTION

1. Field of the Invention

The present invention pertains to a connector element for glass post-and-beam constructions, in which the posts and beams are made of glass, meaning that the glass posts and beams fulfill a load-bearing function, where the load is transmitted between the beam and the post by way of a glass element. The present invention also pertains to a glass post-and-beam construction.

2. Description of the Related Art

The obvious and most important properties of glass are its ability to transmit light and its transparency. As a result, glass has become an important construction material and design element in architecture in recent years. To an increasing extent, architects are now developing plans in which glass is also used as a construction material to form load-bearing structures. These types of transparent structures are often used to create meeting places, communications areas, and corridors for connecting two or more buildings.

In applications of this type, there is a need for a type of post-and-beam construction made entirely of glass to satisfy the architect's requirements for transparency.

Glass, when used in the construction industry, can be categorized generally on the basis of its application as either flat glass, sectional glass, or glass block. In the usual case, the glass will be of the alkali silicate type. This contains a large amount of silicate. When the glass is installed horizontally, it is usually enclosed by a frame so that it can withstand the forces exerted by wind and snow. Such glass must also support its own weight. For this purpose, panes of glass are usually supported on several edges and are thus subjected to bending loads. This has been the standard area of application for glass so far, but today the use of glass as a load-bearing element in itself is becoming increasingly fashionable. "Load-bearing glass" is understood here to be a load-bearing structure consisting entirely of glass. These glass structures include, for example, beams, posts, frames, diagonal struts, stiffeners, etc.

Glass is basically a brittle material, which also has ideal elasticity. Thus glass will fracture without any plastic deformation at all. These properties of glass must therefore be taken thoroughly into account when glass is used as a load-bearing element. For this reason, glass has been defined in various ways in the past, such definitions pertaining either to the material itself or to its state. Glass can be described as a "frozen, supercooled melt".

Float glass, single-pane safety glass, and also partially prestressed glass can be used as the basic elements of load-bearing glass structures. These types of glass are usually made into laminated safety glass. Because these types of glass are already known in themselves, there is no need to discuss them in greater detail here.

Damage to glass, such as the fractures which are or can be caused especially by the stress imposed by different temperatures, proceeds from the edges. The processing of the edges by grinding will increase the strength of the edges, because such processing removes the macrocracks which are formed when the glass is cut.

It is ideal for the surface of the glass to be free of scratches, cracks, and notches, for when a glass pane with preliminary damage is subjected to tensile stress, for example, excessive stress peaks develop at the tips of the cracks. If the strength of the material is exceeded, it can be assumed that supercritical crack growth will occur and that, once such growth has been initiated, the pane will undergo sudden fracture.

Examples of "load-bearing glass" have been published in a research report under the title "Glasträger, Bericht Nr. 20, ETH Zürich, Institut für Hochbautechnik" [Glass Beams, Report No. 20, Zurich Institute of Technology, Department of Structural Engineering], pp. 31-32. The object described here is a glass structure built on the testing grounds of the Architecture Department of Rhine-Westphalian Institute of Technology in Aachen. Both the posts and the beams and therefore the entire load-bearing structure are made of glass. The overlapping areas of the glass posts and beams are connected by the use of holes, which pass through the glass elements and through which suitable metal screw elements are inserted. Single-pane safety glass is used. Because the beams are screwed to the posts, the glass elements (beams, posts) are connected solidly together. The dimensions of these holes must remain within narrow tolerances to ensure that a sufficiently large contact surface is present between the screw heads or nuts and the surface of the glass. For the reasons explained above, these types of holes are relatively expensive to produce.

SUMMARY OF THE INVENTION

It is thus the task of the present invention to provide a connector element for a glass post-and-beam construction and also to provide a glass post-and-beam construction which is simple in design, which can be produced easily and at low cost, which can satisfy the highest requirements with regard to transparency, and which can also be realized with virtually any type of glass. Finally, it should also be possible to install the connectors easily.

The inventive connector element for a glass post-and-beam construction has a first fitting, a second fitting, and a load-transmitting element, which is located between the first and second fittings. The first fitting is connected to a first component of the post-and-beam construction such as a post, and the second fitting is connected to a second component of the post-and-beam construction, e.g., a beam. It should be noted that, as the second component, it is also possible to use another post, which means that two posts can also be connected together. The load is therefore introduced via the first fitting to the load-transmitting element and from there to the second fitting and the post connected to it. The load-transmitting element as well as the components of the post-and-beam construction are also made of glass. As a result, it is possible to create the impression of a "floating beam", because the load-transmitting element is made of glass and is therefore inconspicuous. In addition, there is no longer any need to provide holes in the posts and beams so that they can be connected to each other; this not only lowers the cost of production but also decreases the installation time. To accept the glass load-transmitting element, the first and second fittings preferably have recesses. As a result of the inventive design of the connector element, a post-and-beam construction of glass can be provided which fulfills the highest requirements on transparency without having to meet strict tolerances. A "load-bearing" glass is used for the posts and beams of the post-and-beam construction, so that an effective load-bearing glass structure can be produced.

The glass load-transmitting element is preferably designed in the form of a cylinder or oval shape. As a result, the load is introduced in an especially advantageous manner between the components of the post-and-beam construction. A load-transmitting element with corners can also be used, but there is the danger in this case that the corners will break off.

To minimize the number of projecting parts, the glass load-transmitting element is preferably as thick as or slightly thinner than the glass panes of the components of the post-and-beam construction.

So that the glass load-transmitting element can be produced easily, it is preferably formed out of rolled (cast) glass.

To reinforce the impression of a "floating" beam even more, a predetermined gap is preferably present between the first fitting and the second fitting. It is therefore possible to speak of a "movable bearing", which has neither a positive nor a nonpositive connecting means.

According to a preferred embodiment of the present invention, the first and second fittings are made of metal, especially of a noble metal. It should be noted that any other material, especially plastic, can also be used, provided that it has the necessary strength.

So that the fittings can be attached easily to the components of the post-and-beam construction, each of the fittings preferably has an arched section, which is positioned in a corresponding arcuate recess in the associated post or beam. Thus the fittings can be positioned easily and accurately in the components of the post-and-beam construction. The arched section and the recess are preferably semicircular and/or conform to the shape of the load-transmitting element.

To prevent damage to the glass posts and beams, a glass protector is provided between the fitting and the glass post or beam. The glass protector can be designed as a one-part element, as a two-part element, or as a multi-part, especially a three-part, element.

To prevent damage to the load-transmitting element, furthermore, a cap-like glass protector is preferably installed between the load-transmitting element and each of the fittings. This glass protector can be made of plastic, silicone, or some other suitable material.

The inventive glass post-and-beam construction, in which the posts and beams themselves are made of glass and thus provide the load-bearing structure, makes it possible, in conjunction with the glass connector element, to build highly transparent structures. The post-and-beam design is preferably used as a support structure for overhead glass elements and for glass side elements.

The components of the post-and-beam construction are preferably made of laminated safety glass or of partially prestressed glass or of single-pane safety glass.

When the glass post-and-beam design also has additional inner posts in the interior of the structure, these inner posts are preferably provided with lateral stabilizers of glass. As a result, the inner posts are stabilized even more effectively against buckling in particular. The edge posts of the post-and-beam design are also stabilized in the outside edge area by the glass side elements. It is also conceivable that the posts of the glass post-and-beam design could be connected to other stabilizing components by single-point fasteners, for example. It should also be remarked that the effect of a "floating" beam can be further reinforced by providing additional lighting installations such as low-voltage LEDs.

By means of the inventive connector element, it is therefore possible for the first time to provide a glass post-and-beam design which satisfies the highest requirements and which can also be produced at low cost.

DETAILED DESCRIPTION OF THE PRESENTLY PREFERRED EMBODIMENTS

Figure 1:
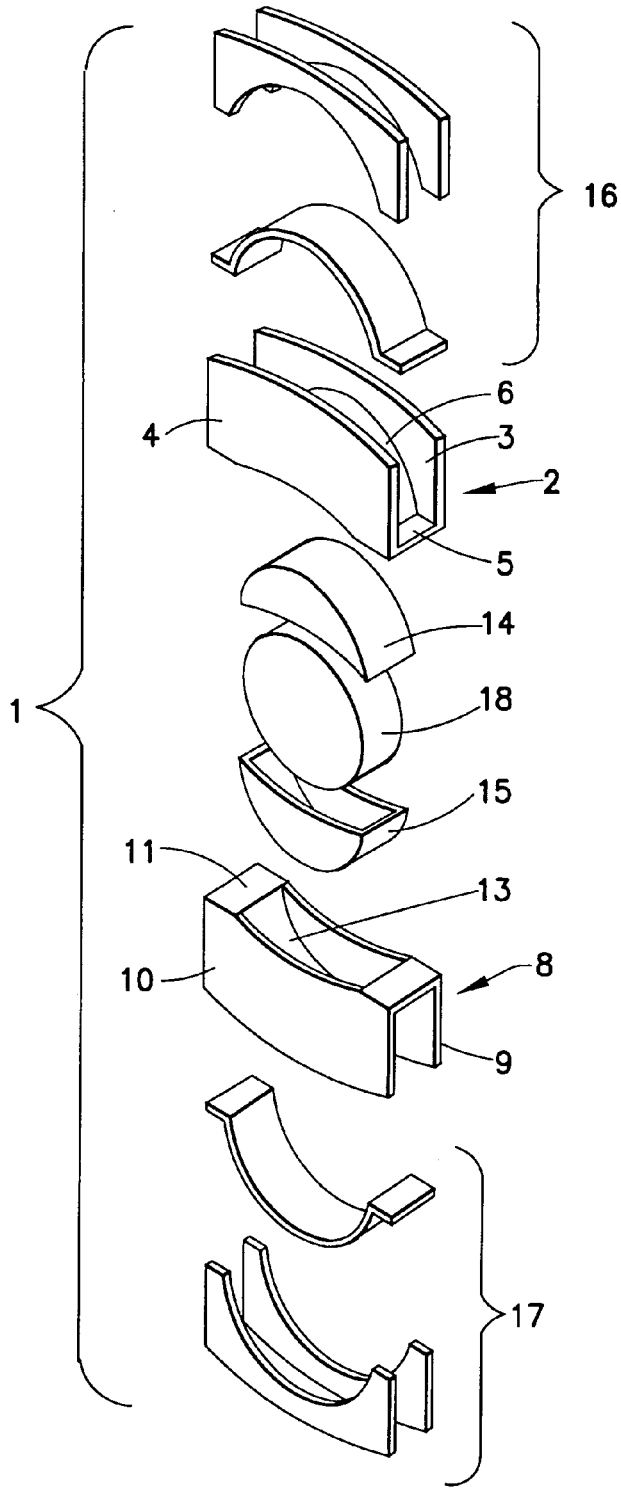
FIG. 1 is an exploded perspective view of a connector element according to an exemplary embodiment of the present invention.

As shown especially in FIG. 1, a connector element 1 according to a first exemplary embodiment comprises a first fitting 2, and second fitting 8, and a load-transmitting element 18, installed between the two fittings 2, 8. The connector element 1 is used for a glass post-and-beam construction, such as that shown in FIGS. 6 and 7. In this glass post-and-beam construction, the posts and beams are made completely of glass, which means that the glass posts and beams must be load-bearing.

Figure 4:
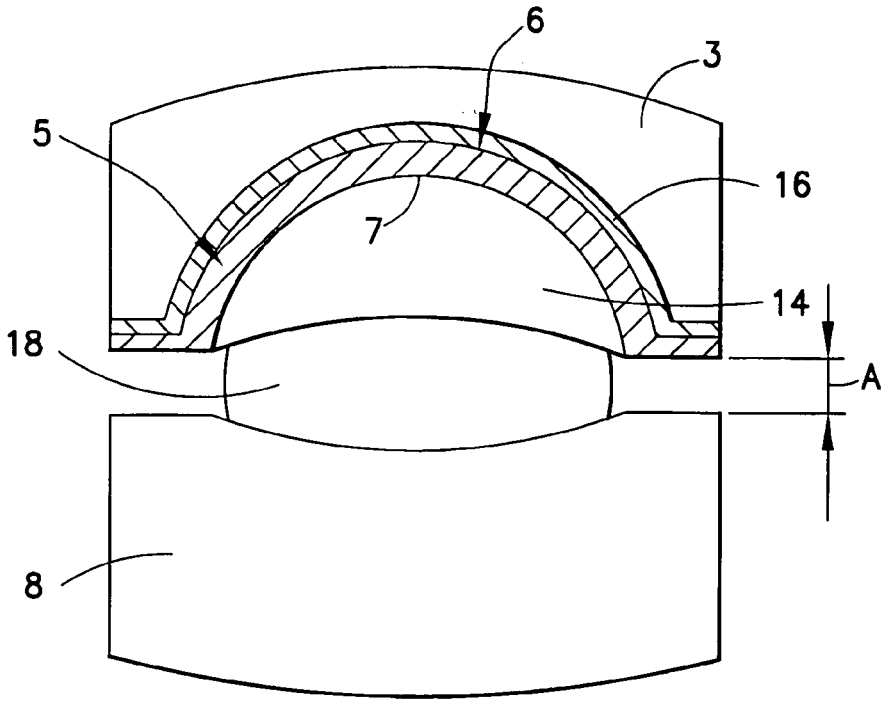
FIG. 4 shows a side view, in partial cross section, of the connector element according to the invention.
Figure 5:
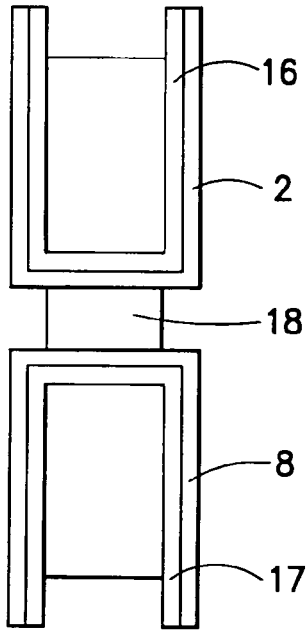
FIG. 5 shows a side view, from the right, of the connector element shown in FIG. 4.

As shown in FIG. 1, the first fitting 2 consists of a one-part base body, which has a base area 5 and two sidewalls 3, 4, one on each side. The base area 5 has an arch-like section 6, which extends across the gap between the two sidewalls 3, 4. There is therefore a correspondingly shaped arcuate recess 7 in the bottom of the first fitting 2 (see FIG. 4). The fitting 2 is made of a noble metal. The fittings 2, 8 can be produced from separate parts, or they can be cast in one piece by a suitable casting method.

As can be seen in FIG. 1, the second fitting 8 is made in the same way as the first fitting 2, consisting of a base body with a base area 11, two sidewalls 9, 10; an arch-like section; and a recess 13. As can be seen especially in FIG. 2, the glass panes used for the posts or beams of the post-and-beam construction are positioned between the sidewalls 3, 4 and 9, 10 of the two fittings 2, 8. A recess (not shown), which corresponds to the arched sections of the base areas 5, 11 of the two fittings 2, 8, is provided in each of the panes. As a result, the fittings 2, 8 can be positioned precisely in the recesses in the panes. To prevent damage to the panes by the metal fittings 2, 8, a glass protector 16, 17 is located between each fitting and the pane. As can be seen in FIG. 1, the shape of the glass protector 16, 17 conforms to the shape of the fittings 2, 8 and to the shape of an arcuate recess in the glass pane. As shown in FIG. 1, the glass protectors 16, 17 are each produced out of three individual parts. It is also possible, however, to use a one-piece glass protector.

FIG. 1 also shows the cylindrical shape of the glass load-transmitting element 18. The thickness of the load-transmitting element 18 (that is, the axial height of the cylinder) corresponds here to the thickness of the glass of the post 29 or of the beam 19. To prevent damage to the load-transmitting element 18 by the fittings 2, 8, a cap-like element 14, 15 is inserted between each of the fittings 2, 8 and the load-transmitting element 18.

It should be noted that, to improve their retention, the glass protectors 14, 15; 16, 17 can be attached to the fittings 2, 8 and to the glass components of the post-and-beam constructions by an adhesive.

Figure 2:
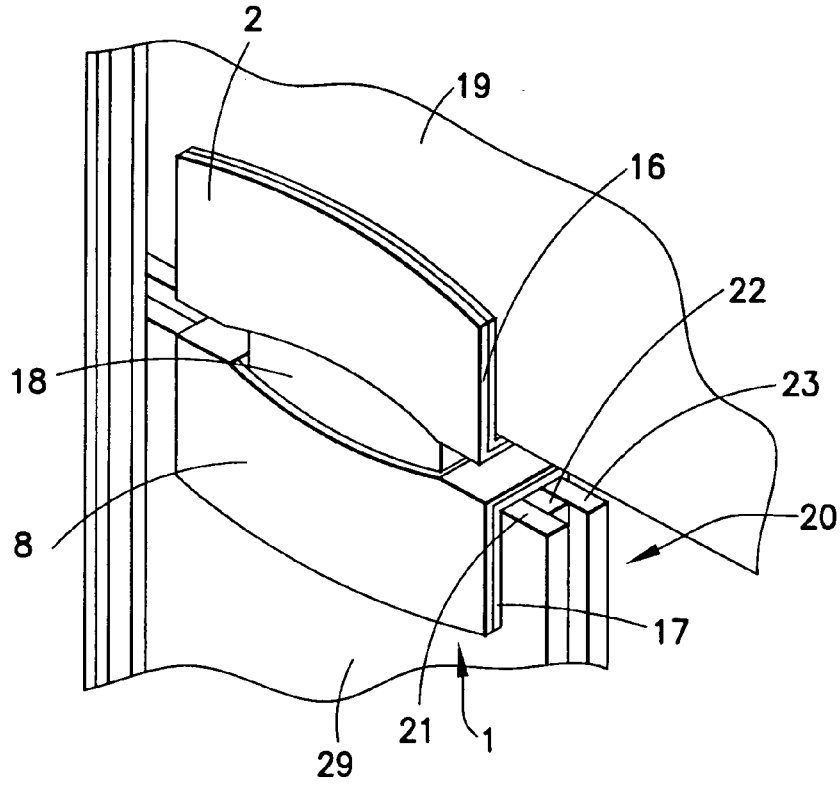
FIG. 2 shows a perspective view of the connector element according to FIG. 1 in the installed state.
Figure 3:
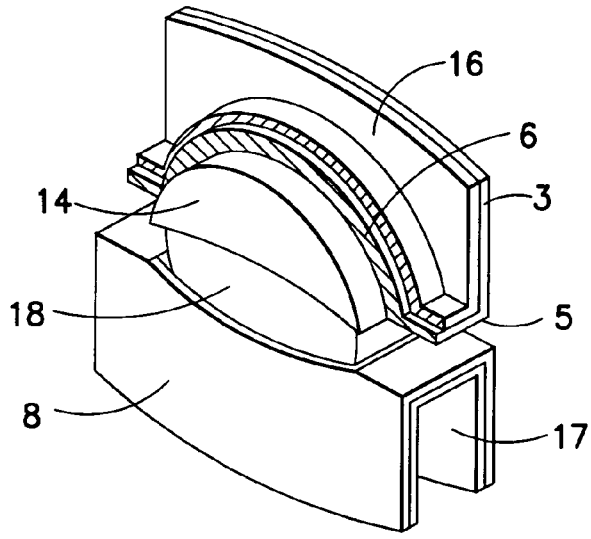
FIG. 3 shows a perspective view, in partial cross section, of the connector element according to the invention.
Figure 6:
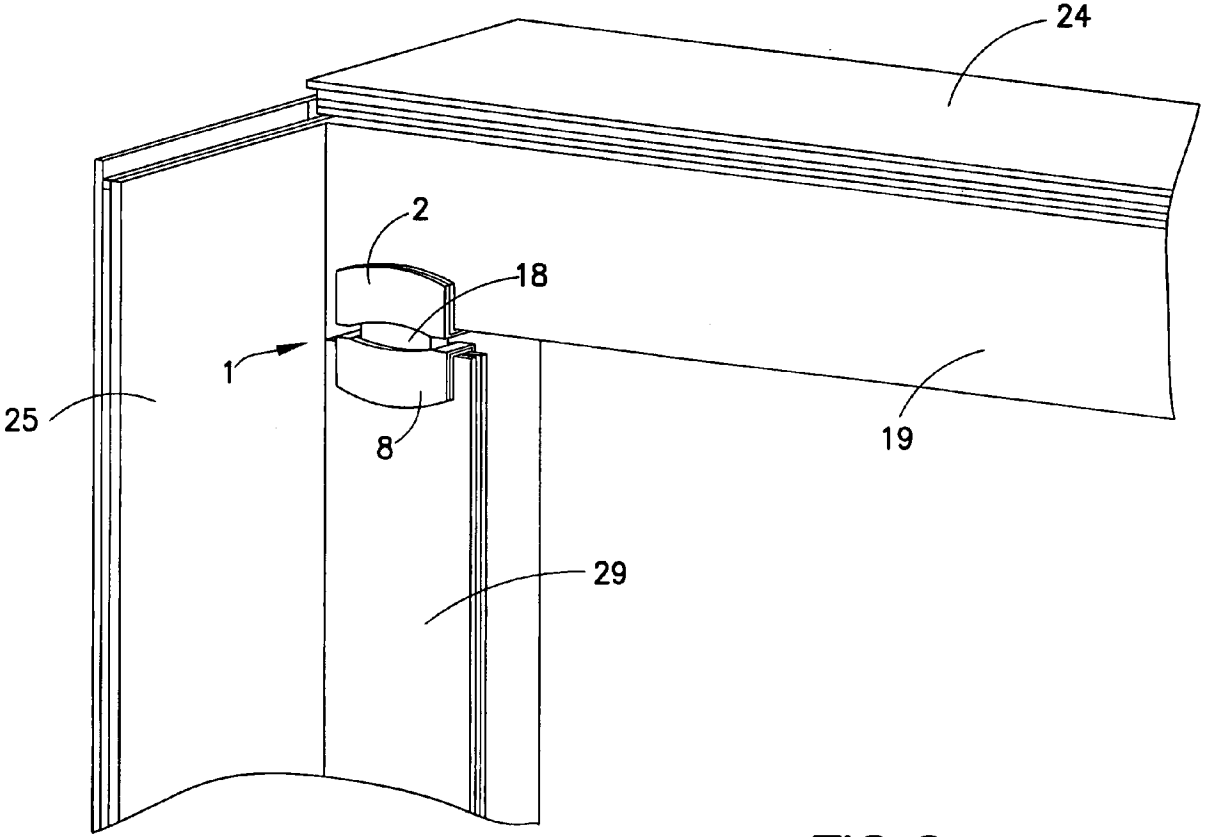
FIG. 6 shows a perspective view of a part of an inventive post-and-beam structure.
Figure 7:
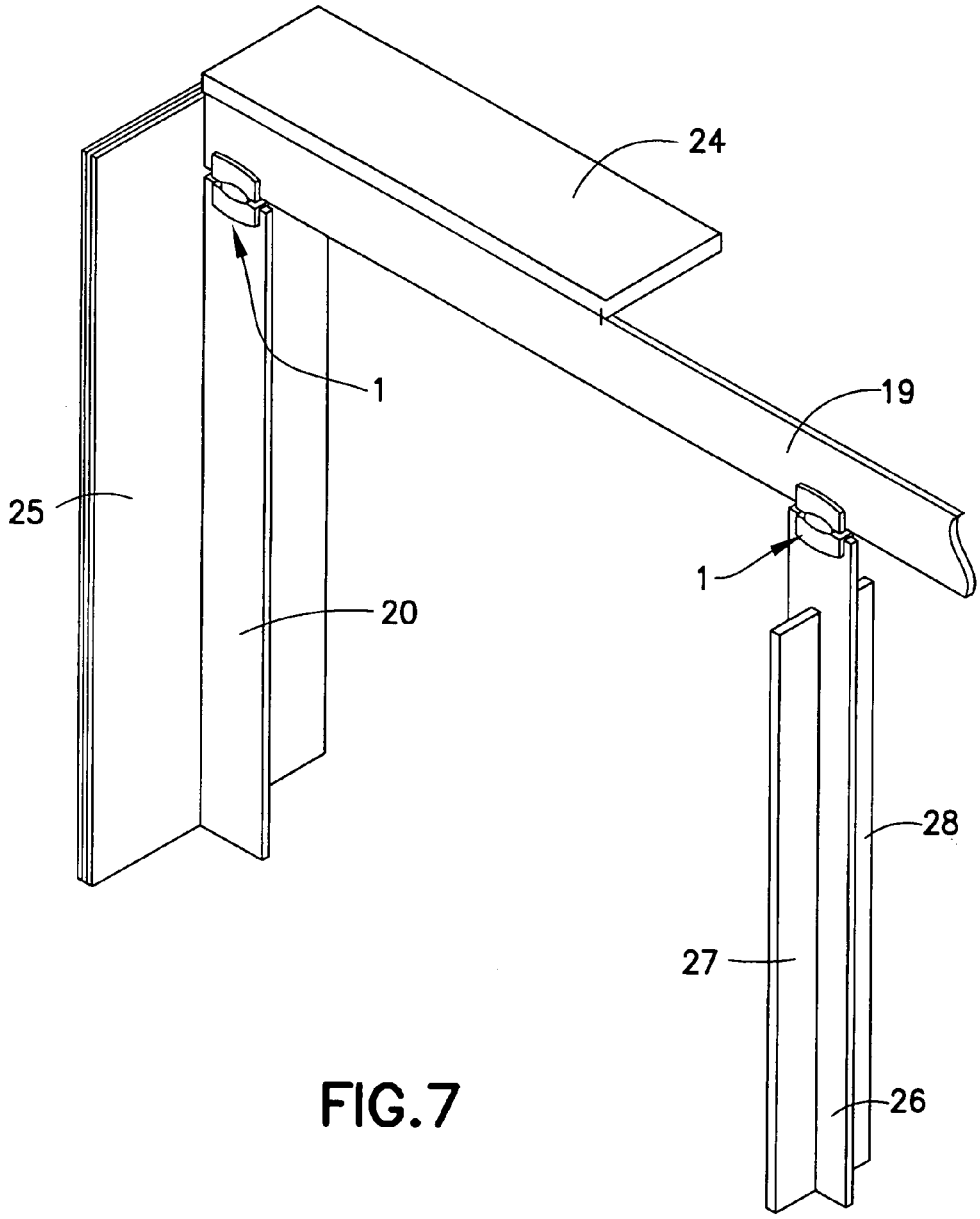
FIG. 7 shows a perspective view of an inventive post-and-beam structure.

The assembled state of the inventive connector element 1 is illustrated especially clearly in FIGS. 2, 6, and 7. A post-and-beam construction is shown, which consists of an edge post 20, an inner post 26, and a beam 19 (see FIG. 7). Inventive connector elements 1 are located in this case between the post 20 and the beam 19 and between the inner post 26 and the beam 19. The posts 20, 26 and the beam 19 are made of laminated safety glass. The inner post 26 is an edge post which is located at the edge inside of the post-and-beam construction. Side glazing 25 is directly adjacent to the edge post 20.

As is especially clear in FIG. 2, the post consists of three panes 21, 22, 23, where only the middle pane 22 has a load-bearing function. The two side panes 21, 23 do not absorb any forces. The two outer panes 21, 23 serve primarily to protect the edges of the middle pane 22.

The post-and-beam construction also serves as a support for the overhead glass elements 24, which rest on the upper edge of the beam 19 and on the upper edge of the side glazing 25. To prevent the individual glass components from damaging each other, an elastomer is preferably provided on the upper edge of the beam 19 and of the side glazing 25. To stabilize the inner post 26, two glass stabilizers 27, 28 are provided along the sides to improve the resistance to buckling. As is especially clear in FIGS. 2 and 6, the load is introduced from the beam 19 and from the overhead elements 24 via the first fitting 2 to the cylindrical glass load-transmitting element 18, from there to the second fitting 8, and thus to the post 20 or 26. As can be derived from the figures, the connector element 1 is designed in such a way that a predetermined gap A is present between the first fitting 2 and the second fitting 8 (see FIG. 4), so that certain portions of the sides of the load-transmitting element 18 are freely exposed. This measure reinforces the impression that the beam 19 of the glass construction is "floating". As can be seen especially clearly in FIGS. 1 and 4, an arched recess with a large radius is provided in the inward-facing surface of each of the fittings 2, 8 in order to improve the transmission of the load.

With the inventive post-and-beam construction and with the inventive connector element for such a construction, therefore, it becomes possible to build an all-glass structure which meets the highest functional and aesthetic requirements. According to the invention, the posts and beams are made out of load-bearing glass, and in addition the connector element 1 also has a glass load-transmitting element 18. In a design of this type, the manufacturing tolerances can be relatively generous, and at the same time the installation times are reduced.

The preceding description of exemplary embodiments of the present invention serves only to illustrate the invention, not to limit it. Within the scope of the invention, various changes and modifications are possible without abandoning the scope of the invention.

The invention claimed is:

1. A connector element operatively connected to a post and beam construction having load-bearing glass components consisting of load-bearing glass posts and load-bearing glass beams, the connector element comprising:

a first fitting configured for connection to a first load-bearing glass component of the post and beam construction;

a second fitting configured for connection to a second load-bearing glass component of the post and beam construction; and a load-transmitting element made of glass, the load-transmitting element being located between and received in the first fitting and the second fitting and configured for transmitting load between the first and second load-bearing glass components of the post and beam construction, wherein the load-transmitting element has one of a cylindrical and an elliptical shape and a curved circumferential surface comprising two opposite portions which are received in the first fitting and the second fitting, respectively.

2. The connector element of claim 1, wherein the cylindrical or elliptical shape has a height which is the same as the thickness of the first and second glass components to which the fittings are fitted.

3. The connector element of claim 1, wherein said fittings are spaced apart by a gap.

4. The connector element of claim 1, wherein the load-transmitting element is made of rolled glass.

5. The connector element of claim 1, wherein the fittings are made of a noble metal.

6. The connector element of 1, wherein each of said fittings has an arched section with an arcuate shape which is received in a correspondingly shaped recess in the respective glass component.

7. The connector element of claim 1, further comprising a glass protector located between each said fitting and the respective glass component.

8. The connector element of claim 7, wherein each said glass protector is made as a three-part component.

9. The connector element of claim 1, further comprising a pair of cap-shaped glass protectors located between the load-transmitting element and respective said first and second fittings.

10. The connector element of claim 9, wherein each said protector is made of plastic or silicone.

11. A post and beam construction comprising:

a first load-bearing glass component consisting of a load-bearing glass post;

a second load-bearing glass component consisting of a load-bearing glass beam; and a connector element comprising:

a first fitting fitted to the first load-bearing glass component;

a second fitting fitted to the second load-bearing glass component; and a load-transmitting element made of glass, the load-transmitting element being located between and received in the first fitting and the second fitting, wherein the load-transmitting element has one of a cylindrical and an elliptical shape.

12. The post and beam construction of claim 11, wherein the load-bearing components are made of at least one of laminated safety glass, pre-stressed glass and single-pane safety glass.

13. The post and beam construction of claim 11, wherein the load-bearing glass beam has lateral stabilizers.

14. The post and beam construction of claim 11, wherein the connector element is a movable bearing.

* * * * *